US006465940B1

(12) United States Patent
Ikeuchi et al.

(10) Patent No.: US 6,465,940 B1
(45) Date of Patent: Oct. 15, 2002

(54) CERMET AND CERAMIC DISCHARGE LAMP

(75) Inventors: Mitsuru Ikeuchi; Yukiharu Tagawa, both of Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/349,092

(22) Filed: Jul. 8, 1999

(30) Foreign Application Priority Data

Jul. 9, 1998 (JP) ..... 10-193990

(51) Int. Cl.[7] ..... H01J 19/50
(52) U.S. Cl. ..... 313/283; 313/623
(58) Field of Search ..... 313/283, 636, 313/624, 34, 623; 252/500, 512; 501/67, 69, 66, 64

(56) References Cited

U.S. PATENT DOCUMENTS 4,354,964 A * 10/1982 Hing et al. ..... 252/518
4,412,963 A * 11/1983 Hing ..... 264/61
4,694,219 A * 9/1987 Hing ..... 313/636
5,271,758 A * 12/1993 Bulijan et al. ..... 75/232
6,066,918 A * 5/2000 Suzuki et al. ..... 313/623

FOREIGN PATENT DOCUMENTS

JP 63008270 A * 6/1986
JP 61-220265 9/1986

* cited by examiner

*Primary Examiner*—Vip Patel
*Assistant Examiner*—Joseph Williams
(74) *Attorney, Agent, or Firm*—Nixon Peabody LLP; David S. Safran

(57) ABSTRACT

A cermet which contains an aluminum oxide component, a silicon dioxide component, a component for modifying the coefficient of linear expansion which is formed of a metal oxide other than aluminum oxide and silicon dioxide, and a metal component with a smaller coefficient of linear expansion than aluminum oxide. A ceramic discharge lamp which has a discharge vessel with an arc tube part and hermetically sealed tube parts, in which furthermore in the arc tube part there are a pair of discharge electrodes opposite one another, and in which a hermetically sealed arrangement is obtained by fritting-welding of hermetically sealing components with the hermetically sealed tube parts, in the hermetically sealed components the base parts of the upholding parts of the electrodes being inserted, on the tips of which the discharge electrodes are located, and in which the hermetically sealing components are formed of the above described cermet.

8 Claims, 1 Drawing Sheet

CERMET AND CERAMIC DISCHARGE LAMP

BACKGROUND OF THE INVENTION

1. Field of the Invention

The invention relates to cermets and a ceramic discharge lamp in which the cermet is used for the hermetically sealing components.

2. Description of the Related Art

FIG. 1 is a schematic cross section of one example of a conventional ceramic discharge lamp which has a discharge vessel 3 of translucent ceramic with an arc tube part 1 and hermetically sealed tube parts 2 which are joined to the arc tube part 1. In the arc tube part 1, there are a pair of discharge electrodes 4 opposite one another. The discharge electrodes 4 are located in the tip areas of the upholding parts of the electrodes 5. The base parts of the upholding parts of the electrodes 5 are inserted into hermetically sealing components 6. A hermetically sealed arrangement is obtained by fritting-welding of these components 6 in the tube part 2. In FIG. 1, an outer lead 7 is shown inserted into each of the components 6. The ceramic discharge lamp with this arrangement is described, for example, in Japanese patent disclosure document SHO 61-220265.

The component 6 in this discharge lamp is made of a conductive cermet, which is obtained by sintering of ceramic powder and metal powder, and is hermetically welded by a glass frit (not shown in the drawing) in the tube part 2.

The ceramic powder for obtaining this cermet is the same material as the translucent ceramic comprising the discharge vessel 3, for example, polycrystalline aluminum oxide powder.

Molybdenum powder or tungsten powder is used as the metal powder. To ensure the conductivity necessary for power supply, the metal component for the entire cermet is contained in a percentage by volume of 30 to 60%.

Metals such as molybdenum and tungsten which are contained in the cermet have a smaller coefficient of linear expansion than a ceramic like aluminum oxide. The coefficient of linear expansion of the cermet which comprises the component 6 is therefore less than the coefficient of linear expansion of the ceramic by itself which comprises the cermet. This means that when using the same material as the translucent ceramic comprising the discharge vessel 3 for the ceramic comprising the cermet, the coefficient of linear expansion of the cermet to be obtained is less than the coefficient of linear expansion of the translucent ceramic comprising the discharge vessel 3.

As a result, the following disadvantage arises when the hermetically sealing components are formed, for example, from a conductive cermet based on aluminum oxide-molybdenum, fritting-welding of these hermetically sealing components on the discharge vessel of translucent aluminum oxide ceramic is performed, and thus a discharge lamp is produced. In particular, either in the cooling process in fritting-welding or soon after use of the lamp commences, i.e., within a few hundred hours after starting of discharge lamp operation, cracks form at the welded sites due to the different coefficients of thermal expansion of the material components of the hermetically sealing components and the discharge vessel.

SUMMARY OF THE INVENTION

The invention was devised to eliminate the above described defect in the prior art. Therefore, a first object of the invention is to devise a cermet which has a suitable coefficient of linear expansion for a hermetically sealing component of a discharge lamp of ceramic which can be easily produced and which inherently has a high hermetically sealing property.

A second object of the invention is to devise a discharge lamp of ceramic in which a sufficiently hermetically sealed arrangement, and thus a long service life, are obtained by hermetically sealing components of the above described cermet.

In these application documents, the expression "average coefficient of linear expansion" means the average value of the coefficient of linear expansion at 25 to 350° C.. This coefficient of linear expansion was determined according to Fis R 3102-1978.

The above objects are achieved in accordance with the invention by the cermet having an aluminum oxide component, a silicon dioxide component, a component for modifying the coefficient of linear expansion, which is formed of a metal oxide other than aluminum oxide and silicon dioxide, and a metal component with a smaller coefficient of linear expansion than aluminum oxide.

The objects of the invention are, furthermore, advantageously achieved in that the silicon dioxide component is contained in a percentage by volume of 5 to 30% in the above described cermet.

The objects of the invention are, moreover, advantageously achieved in that the average coefficient of linear expansion of the above described cermet is $5.6\times10^{-6}$ to $7.6\times10^{-6}$ (1/K).

In a discharge lamp of translucent ceramic which has a discharge vessel with an arc tube part and hermetically sealed tube parts which are joined to the arc tube part, in which in the arc tube part there are a pair of discharge electrodes opposite one another, and in which a hermetically sealed arrangement is obtained by fritting-welding of hermetically sealing components onto the hermetically sealed tube parts, in the hermetically sealing components the base parts of the upholding parts of the electrodes being inserted, on the tips of which the discharge electrodes are located, the object of the invention is, furthermore, achieved in that the hermetically sealing components are formed of the above described cermet.

In a discharge lamp of translucent ceramic which has a discharge vessel with an arc tube part and hermetically sealed tube parts which are joined to the arc tube part, in which furthermore in the arc tube part there are a pair of discharge electrodes opposite one another, and in which a hermetically sealed arrangement is obtained by fritting-welding of cylindrical or disc-shaped hermetically sealing components onto the outer faces of hermetically sealed tube parts, in the hermetically sealing components the base parts of the upholding parts of the electrodes being inserted, on the tips of which the discharge electrodes are located, the object of the invention is, moreover, achieved in that the hermetically sealing components are formed of the above described cermet.

By composition from an aluminum oxide component, a silicon dioxide component, a component for modifying the coefficient of linear expansion which consists of a metal oxide other than aluminum oxide and silicon dioxide, and a metal component with a smaller coefficient of linear expansion than aluminum oxide, a cermet is obtained with a coefficient of linear expansion which is identical or is similar to that the translucent ceramic which is advantageously used as the material of the discharge vessel. The reason for this is that, by modifying the content of the component contained for modifying the coefficient of linear expansion which consists of a metal oxide other than aluminum oxide and silicon dioxide, the coefficient of linear expansion of the cermet to be obtained can be modified.

In particular, by using silicon dioxide as the essential component, at a low sintering temperature, a cermet can be obtained which inherently has to a sufficient degree a higher hermetically sealing property than in the case in which no silicon dioxide is used.

By using the above described cermet for the hermetically sealing components of a ceramic discharge lamp, it is possible to effectively prevent cracks from forming at the locations where fritting-welding to the hermetically sealed tube parts of the discharge vessel took place. Furthermore, a ceramic discharge lamp with a long service life can be obtained. In this case, it is desirable for the hermetically sealed components to be cylindrical or disk-shaped and to be frit-welded with the outer faces of the hermetically sealed tube parts.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 2:
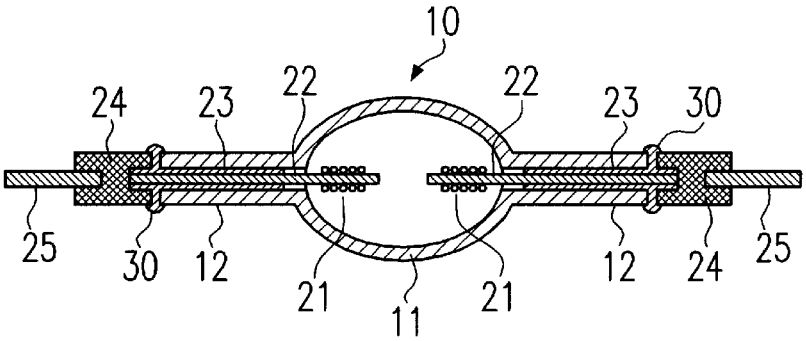
FIG. 2 is a schematic cross-sectional view of an example of a ceramic discharge lamp in accordance with the present invention.

FIG. 2 is a schematic cross section of an example of a ceramic discharge lamp in accordance with the invention in which a discharge vessel 10 has an oval arc tube part 11 and hermetically sealed tube parts 12 which are joined to the arc tube part 11 in such a way that they project from opposite ends of the arc tube part 11. The discharge vessel 10 is made of a translucent ceramic.

The discharge vessel 10 has the following dimensions:

length: 28 to 40 mm maximum outside diameter of the arc tube part 11: 4.0 to 10.0 mm inside volume: 0.05 to 0.6 $cm^3$ outside diameter of the hermetically sealed tube part 12: 1.8 to 2.6 mm inside diameter of the hermetically sealed tube part 12: 0.3 to 1.2 mm Polycrystalline aluminum oxide, polycrystalline yttrium-aluminum garnet (YAG), polycrystalline yttrium oxide or the like can be used as the translucent ceramic of which the discharge vessel 10 is made. However, among them, polycrystalline aluminum oxide is preferred.

In this discharge vessel 10, the arc tube part 11 and the hermetically sealed tube parts 12 are joined integrally to one another. However, the form of the discharge vessel 10 and the methods for its production methods are not limited. For example, one end of the component for forming the hermetically sealed tube part can be inserted at a time into openings on the two ends of the component forming the arc tube part, and in this way, a component for forming the discharge vessel can be produced, one of the ends of the components for forming the hermetically sealed tube parts can be hardened and attached when the component forming the discharge vessel is sintered, and thus the hermetically sealed tube parts can be joined to the two ends of the arc tube part.

Within the arc tube part 11 of the discharge vessel 10 there are a pair of opposed discharge electrodes 21. These discharge electrodes 21 extend from the arc tube part 11, through the inside of the tube parts 12 and project from the tube parts 12. The discharge electrodes 21 are produced by one end of the upholding parts 22 of the electrodes being wound with an electrode spiral.

In the upholding parts 22 of the electrodes 21, in an area from which the side of the end is removed, i.e. from the area which is present in the tube part 12, as far as the other end, there is a sleeve 23. The base part of the upholding parts 22 of the electrodes which is provided with the sleeve 23 is inserted on the side of the inner face of a hermetically sealing component 24 which is located on the outer end of the discharge electrode 21 and which is made cylindrical. On the side of the outer face of this hermetically sealing component 24, an end of an outer lead pin 25 which extends to the outside is inserted. An electrode module is formed by the discharge electrodes 21, the upholding parts 22 of the electrodes, the sleeves 23, the hermetically sealing components 24 and the outer lead pins 25.

In FIG. 2, a frit-sealing body 30 is located between the outside face of the tube part 12 and the inside face of the hermetically sealing component 24. The component 24 is frit-welded to the outer face of the tube part 12 via this frit-sealing body 30. In this way, the position of the discharge electrode 21 is fixed and a hermetically sealed arrangement is formed. In this case, as the frit-sealing body, a material can be used which is based on an oxide of the rare earths—aluminum oxide—silicon dioxide and the like.

By means of this arrangement in which the component 24 is flit-welded to the outer face of the tube part 12 of the component 24, in a discharge vessel with hermetically sealed tube parts with a small diameter, such as, for example, with an inner diameter of less than or equal to 0.8 mm, a hermetically sealed arrangement can be reliably formed and a discharge lamp of ceramic with a small shape can be effectively produced.

In the above described example, the upholding parts 22 of the electrodes are made of tungsten wire with a diameter of 0.15 to 0.5 mm, for example, and the outer lead pin 25 is made of a tungsten wire, a molybdenum wire or a wire of a metal from the platinum group with a diameter of, for example, 0.2 to 0.7 mm. The electrode spiral with which the tip area of the upholding parts 22 of the electrodes is wound is formed of a tungsten wire with a diameter of, for example, 0.06 to 0.3 mm.

The outer diameter of the sleeve 23 fits within the inner diameter of the tube part 12. It is desirable that the inner diameter of the sleeve 23 has a size which fits together with the diameter of the upholding parts 22 of the electrodes. It is especially preferred that the difference between the outer diameter of the sleeve 23 and the inner diameter of the tube part 12 is small. It is desirable that it is specifically 0.12 mm. In this way, the distance between the two is relatively small, and it becomes possible to keep the amount of the added material which penetrates and condenses here small.

For the material of the sleeve, it is possible to use a ceramic with a coefficient of linear expansion which is identical or similar to the coefficient of linear expansion of the translucent ceramic which forms the discharge vessel 10, such as, for example, polycrystalline aluminum oxide, polycrystalline YAG, polycrystalline yttrium or the like.

The cermet used in accordance with the invention contains an aluminum oxide component, a silicon dioxide component, a component for modifying the coefficient of linear expansion which is made of a metal oxide other than aluminum oxide and silicon dioxide, and a metal component with a smaller coefficient of linear expansion than aluminum oxide. By means of this measure, a cermet with an average coefficient of linear expansion in the range from $5.6\times10^{-6}$ to $7.6\times10^{-6}$ (1/K) can be obtained which is matched to the translucent ceramic which is used as the material for the discharge vessel.

In the invention, the aluminum oxide component is the base material of the cermet. Its content in the conductive cermet is a percentage by volume from 15 to 60%.

The silicon dioxide component is an effective component because it inherently exerts only minor influences on the average coefficient of linear expansion of the cermet and even at a low sintering temperature, a cermet can be obtained with a sufficiently sealing action. The silicon dioxide content in a conductive cermet is, for example, a percentage by volume from 5% to 30%. In the case of an extremely low content of the silicon dioxide component, a sufficiently high sealing action at a short sintering time of roughly 5 minutes cannot be obtained. To obtain a sealing action, it is necessary to sinter at least 20 minutes at 1700° C. In the case of an overly large content, on the other hand, the sealing action increases, but a vitreous phase forms; this causes deformation during sealing.

The component for modifying the coefficient of linear expansion which is formed of a metal oxide other than aluminum oxide and silicon dioxide modifies the average coefficient of linear expansion of the obtained cermet and is hereinafter called "the component for modifying the coefficient of linear expansion." This component suppresses the reduction of the coefficient of linear expansion which is caused by the metal component, which is another essential component.

A metal oxide or a ceramic in which the average coefficient of linear expansion is greater than that of aluminum oxide can be chosen as the material which is used as the component for modifying the coefficient of linear expansion.

Specifically, the following example can be named:

magnesium oxide (coefficient of linear expansion: $13.3\times10^{-6}$ (1/K)

magnesium-aluminum oxide (coefficient of linear expansion: $8.4\times10^{-6}$ (1/K)

yttrium oxide (coefficient of linear expansion: $7.8\times10^{-6}$ (1/K)

lanthanum oxide (coefficient of linear expansion: $7.7\times10^{-6}$ (1/K)

an oxide of the rare earths.

The content of the component for modifying the coefficient of linear expansion in a conductive cermet is, for example, a percentage by volume from 5 to 40%, the content differing depending on the material.

The metal component with a smaller coefficient of linear expansion than aluminum oxide (hereinafter called simply "the metal component") is an essential component for imparting a certain conductivity to the cermet to be obtained.

Specifically, the following metals with a high melting point are examples of materials which can be used as the metal component:

tungsten (coefficient of linear expansion: $4.6\times10^{-6}$ (1/K)

tantalum (coefficient of linear expansion: $6.5\times10^{-6}$ (1/K)

molybdenum (coefficient of linear expansion: $4.9\times10^{-6}$ (1/K)

The content of the metal component in a conductive cermet is, for example, a percentage by volume from 30 to 60%, the content differing depending on the material.

To guarantee sufficient conductivity in a cermet to be obtained, in practice, at least 30% by volume relative to total volume of all of the components of this cermet is necessarily constituted by a conductive material. In the case in which the content of the metal component is a percentage by volume of less than 30%, it is therefore necessary that a conductive material is selected as at least part of the component for modifying the coefficient of linear expansion, and that the total content of the conductive metal component and of the component for modifying the coefficient of linear expansion is a percentage by volume of at least 30%. In the cermet of the invention, it is preferred that the electrical resistance is less than or equal to 0.1 Ωcm.

The coefficient of linear expansion of the cermet to be obtained is not clearly fixed by the coefficients of linear expansion of the components which comprise the cermet nor by the mixing ratio. To obtain the desired size of the coefficient of linear expansion of the cermet to be obtained, it is therefore necessary to change the percentage of the respective components used, especially the proportion of the aluminum oxide component and of the component for modifying the coefficient of linear expansion in different ways, to modify the cermet in practice, and based on the data of the measured coefficients of linear expansion of the components to determine an optimum proportion for use.

In this way, a cermet can be obtained with an average coefficient of linear expansion is in a certain quantitative range from $5.6\times10^{-6}$ to $7.6\times10^{-6}$ (1/K).

The average coefficient of linear expansion of the translucent ceramic from which the discharge vessel 10 is to be formed differs on the other hand depending on the production method, its density, its crystal orientation and the like. For the aluminum oxide crystal it is $6.6\times10^{-6}$ (1/K), for the YAG polycrystal $7.2\times10^{-6}$ (1/K) and for the yttrium oxide polycrystal $7.8\times10^{-6}$ (1/K).

The cermet of the invention therefore has an average coefficient of linear expansion which is identical or similar to that of the translucent ceramic of the discharge vessel 10. By using this cermet as the material of the hermetically sealing components 24, when the discharge lamp is produced from ceramic and during its operation, cracks can be reliably prevented from forming at the locations where the hermetically sealed tube parts 12 are welded to the hermetically sealing components 24 of the discharge vessel 10. Furthermore, a ceramic discharge vessel can furthermore be obtained with a reliably high hermetically sealed arrangement, and thus, with a long service life.

This means that an advantageous state can be easily accomplished in which the difference between the average coefficient of linear expansion of the cermet comprising the hermetically sealing components 24 and the average coefficient of linear expansion of the translucent ceramic from which the discharge vessel 10 is formed is less than or equal to $1.0\times10^{-6}$ (1/K). In this way, cracks can be effectively prevented from forming at the locations where the hermetically sealed tube parts 12 are welded to the hermetically sealing components 24 of the discharge vessel 10. Furthermore, a reliably high hermetically sealed arrangement can be produced.

Figure 3:
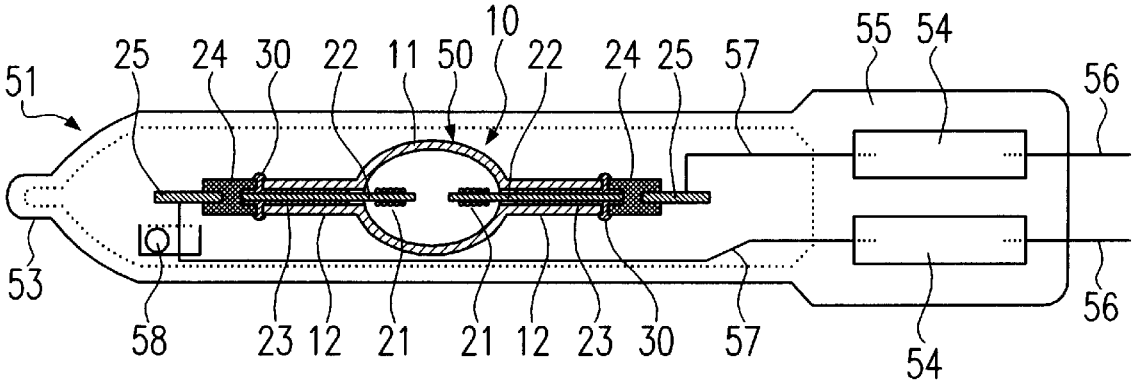
FIG. 3 is a schematic cross section of another example of a ceramic discharge lamp according to the present invention.

FIG. 3 is a schematic cross section of the arrangement of an example of a metal halide lamp of the double tube type in which a ceramic discharge lamp according to the present invention is used as the inside tube.

In the metal halide lamp shown in FIG. 3, there is an inside tube 50 which consists of the ceramic discharge lamp of this invention (for example, of the discharge lamp 10 shown in FIG. 2) in an outside tube 51. The outside tube 51 of the metal halide lamp has, on one end, a residue of an outlet tube 53 while on the other end there is a pinch sealed foot area 55 into which a molybdenum foil 54 has been inserted. The outside tube 51 is formed of fused silica glass or hard glass. The inside of the outside tube 51 is under a vacuum by evacuation.

In FIG. 3, supply leads 56 are electrically connected via the molybdenum foils 54 and inside leads 57 to the outer lead pin 25 of the inside tube 50 (ceramic discharge lamp 10).

A getter 58 of Zr—Al alloy is spot welded with a holding device (not shown) which is located inside the outer tube 51.

Figure 1:
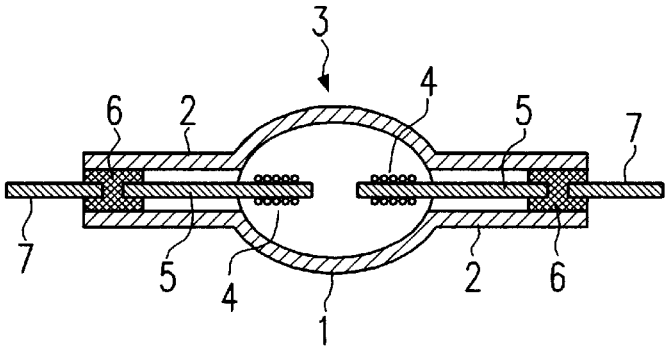
Fig. 1 (Prior Art)
FIG. 1 is a schematic cross section of one example of a conventional ceramic discharge lamp.

The hermetically sealing components 24 which have been obtained from the cermet according to the invention are not limited to the arrangement shown in FIG. 2, but they can also be used, for example, in the hermetic arrangement shown in FIG. 1. Furthermore, in the arrangement shown in FIG. 2 the sleeves 23 are not absolutely necessary.

In the following, the invention is further described using several embodiments. The invention is however not limited to these embodiments.

Production Example 1

45 percent by volume of aluminum oxide powder with an average grain size of 2 microns, 10 percent by volume of silicon dioxide powder with an average grain size of 1 micron, 5 percent by volume of magnesium oxide powder with an average grain size of 5 microns and 40 percent by volume of fine molybdenum powder with an average grain size of 0.5 microns were mixed and subjected to compaction. In this way, a compacted body was produced from this mixture.

This compacted body was heated at 1700° C. for five minutes and was thus sintered. In this way, a sinter body (cylinder with a diameter of 1.8 mm and a length of 5 mm) was produced from the cermet in accordance with the invention based on $Al_2O_3$—$SiO_2$—MgO—Mo.

Production Examples 2 to 5

As is illustrated using Table 1, besides changing the content of the respective component, a sinter body was produced in the conventional manner from the cermet according to the invention based on $Al_2O_3$—$SiO_2$—MgO—Mo.

Production Example 6

25 percent by volume of aluminum oxide powder with an average grain size of 2 microns, 10 percent by volume of silicon dioxide powder with an average grain size of 1 micron, 25 percent by volume of dysprosium oxide powder with an average grain size of 0.5 microns and 40 percent by volume of fine molybdenum powder with an average grain size of 0.5 microns were mixed and subjected to compaction. In this way, a compacted body was produced from this mixture.

This compacted body was heated at 1700° C. for five minutes and was thus sintered. In this way, a sinter body was produced from the cermet in accordance with the invention based on $Al_2O_3$—$SiO_2$—$DY_2O_3$—Mo.

Comparison Production Example

Besides the fact that no silicon dioxide was used, a sinter body was produced from the cermet based on $Al_2O_3$—MgO—Mo for comparison purposes in the same way as in production example 1.

Production Example for Information Purposes

Besides the fact that a compacted body was heated and sintered at 1900° C. for five minutes, a sinter body was produced from the cermet based on $Al_2O_3$—MgO—Mo for comparison purposes in the same way as in the comparison example.

In the respective cermet sinter body obtained in the above described manner, the specific electrical resistance was measured using the tetrode method and the coefficient of linear expansion was measured using a measurement device for a coefficient of linear expansion. In this way the average coefficient of linear expansion was determined. Table 1 shows the result.

TABLE 1

| | Cermet compos. (Mixing ratio) (% by vol.) | Elect. resistance | Aver. coef. of linear exp. |
|---|---|---|---|
| Production example 1 | $Al_2O_3$—$SiO_2$—MgO—Mo (45:10:5:40) | 2883 | 7.0 |
| Production example 2 | $Al_2O_3$—$SiO_2$—MgO—Mo (40:10:10:40) | 2513 | 7.0 |
| Production example 3 | $Al_2O_3$—$SiO_2$—MgO-Mo (35:10:15:40) | 3119 | 6.6 |
| Production example 4 | $Al_2O_3$—$SiO_2$—MgO—Mo (30:10:20:40) | 1627 | 5.8 |
| Production example 5 | $Al_2O_3$—$SiO_2$—MgO—Mo (25:10:25:40) | 1287 | 5.7 |
| Production example 6 | $Al_2O_3$—$SiO_2$—$Dy_2O_3$—Mo (25:10:25:40) | 1200 | 6.3 |
| Comparison prod. example | $Al_2O_3$—MgO—Mo (20:40:40) | 652 | 6.5 |

Embodiment 1

A metal halide lamp of the alternating current type (rated output: 20 W) with the arrangement shown in FIG. 2 was produced under the conditions described below.

A discharge vessel 10 was produced from polycrystalline aluminum oxide (average grain size: roughly 30 microns, average coefficient of linear expansion: $6.6\times10^{-6}$/K) with a total length of 30 mm, a maximum outside diameter of the arc tube part 11 of 5.8 mm, a thickness of the arc tube part 11 of 0.5 mm, an inside volume of the arc tube part 11 of roughly 0.1 $cm^3$, an inner diameter of the hermetically sealed tube parts 12 of 0.75 mm, and an outer diameter of the tube part 12 of 1.8 mm.

After inserting the base parts of the upholding parts 22 of the electrodes which are provided with sleeves 23, on the inner faces of the hermetically sealing components 24, the ends of the outer lead pins 25 were inserted onto the outer faces of the components 24. This yielded an electrode module composed of the discharge electrodes 21, the upholding parts 22 of the electrodes, the sleeves 23, the hermetically sealing components 24 and the outer lead pins 25.

Here, upholding parts 22 of the electrodes of tungsten wire with a diameter of 0.2 mm and a length of 13 mm were used.

The electrode spiral comprising the discharge electrode 21 was formed by winding tungsten wire with a diameter of 0.08 mm. There were six turns.

Sleeves 23 of polycrystalline aluminum oxide with an outside diameter of 0.72 mm, an inside diameter of 0.23 mm and a length of 5 mm are used.

A sintered body (cylinder with a diameter of 1.8 mm and a length of 5 mm) produced from the cermet based on $Al_2O_3$—$SiO_2$—MgO—Mo which was obtained in the production example 1 was used for the hermetically sealing component 24.

Outer lead pins 25 of tungsten wire with a diameter of 0.3 mm were used.

The arc tube part 11 was filled with 2.5 mg mercury, 3.2 mg of iodide bound to dysprosium-thallium-sodium ($DyI_3$—TlI—NaI) with a weight ratio of 33:10:57 and argon gas with a filling pressure of 13 kPa. The outer faces of the tube parts 12 and the inner faces of the components 24 were adjoined to one another via a frit ring (based on $Dy_2O_3$—$Al_2O_3$—$SiO_2$, average coefficient of linear expansion: $7.0\times10^{-6}$/K, inside diameter: 0.8 mm, outside diameter: 2.0 mm, thickness: 1 mm). In this way, there was an electrode module in the discharge vessel 10 (distance between the discharge electrodes: 3.0 mm). Next, the frit ring was heated to 1700° C. and thus subjected to frit-welding. Thus, a hermetically sealed arrangement was formed and the discharge lamp of the invention was produced.

In the discharge lamp of the invention obtained in this way, the locations where the tube parts 12 of the discharge vessel 10 are welded to the components 24 were studied. No cracks could be detected. Even after 1000 hours of being turned on and off at intervals of 15 minutes on and 15 minutes off, no cracks could be detected at these locations. The starting voltage was roughly 750 V.

Embodiments 2 to 6

Besides the fact that the respective sinter body produced from the cermet which was obtained in production examples 2 to 6 was used as the hermetically sealing component, a discharge lamp according to the invention was produced in the same way as in embodiment 1.

In each of the discharge lamps which were obtained in this way, the locations where the tube parts 12 of the discharge vessel 10 are welded to the components 24 were studied. No cracks could be detected. Furthermore, even after being turned on and off under the same conditions as in the first embodiment 1, no cracks could be detected at these locations.

Comparison Example 1

Besides the fact that the sinter body of the cermet based on $Al_2O_3$—MgO—Mo which was obtained in the comparison production example was used as the hermetically sealing component, a discharge lamp was produced in the same way as in the first embodiment 1 for comparison purposes.

The welded sites were studied in the discharge lamp obtained in this way. No cracks could be detected at the welded sites. However, after being allowed to lie for one day after production, the starting voltage increased and operation was no longer possible.

Example 1 for Information Purposes

Besides the fact that a compacted body of the cermet based on $Al_2O_3$—MgO—Mo which was obtained in the production example for information purposes was used as the hermetically sealing component, a discharge lamp was produced in the same way as in embodiment 1 for comparison purposes.

The welded sites were studied in the discharge lamp obtained in this way. No cracks could be detected at the welded sites. The lamp had been operated under the same conditions as in comparison example 1.

It can be concluded from the above described embodiments 1 to 6 that, in accordance with the invention, a cermet can be obtained which has an average coefficient of linear expansion which is identical or similar to that of the translucent ceramic and which is suitable as the hermetically sealing components of a ceramic discharge lamp.

Furthermore, it is apparent that, by the feature of the invention that a silicon dioxide component is contained, even upon sintering at a low temperature of 1700° C., the resulting cermet has a sufficient sealing action. On the other hand, it is apparent that, in the case of not using the silicon dioxide component, the cermet sintered at 1700° C. in comparison example 1 does not have a sufficient sealing action, unless the sintering is produced at a high temperature of 1900° C., as in the example for comparison purposes.

Action of the Invention

By the composition from an aluminum oxide component, a silicon dioxide component, a component for modifying the coefficient of linear expansion which is formed of a metal oxide other than aluminum oxide and silicon dioxide, and a metal component with a smaller coefficient of linear expansion than aluminum oxide, a cermet can be obtained with a coefficient of linear expansion which is identical or similar to the coefficient of linear expansion of a translucent ceramic, which is advantageously used as the material of the discharge vessel.

This is because, by modifying the content of the contained component for modifying the coefficient of linear expansion which is formed of a metal oxide other than aluminum oxide and silicon dioxide, the coefficient of linear expansion of the cermet to be obtained can be modified.

In particular, by using silicon dioxide as the essential component, even at a low sintering temperature, a cermet can be obtained which inherently has to a sufficient degree, a higher hermetically sealing property than in the case in which no silicon dioxide is used.

By using the above described cermet for the hermetically sealing components of a ceramic discharge lamp, it is therefore possible to effectively prevent cracks from forming at the locations where fritting-welding with the hermetically sealed tube parts of the discharge vessel took place. Furthermore, a ceramic discharge lamp with a long service life can be obtained.

What we claimed is:

1. Cermet comprising an aluminum oxide component, a silicon dioxide component, a component for modifying the coefficient of linear expansion which is formed of a metal oxide other than aluminum oxide and silicon dioxide, and a metal component with a smaller coefficient of linear expansion than aluminum oxide, wherein the cermet has an average coefficient of linear expansion in a temperature range of from 25° C. to 350° C. of $5.6\times10^{-6}$ to $7.6\times10^{-6}$ (1/K).

2. Cermet comprising an aluminum oxide component, a silicon dioxide component, a component for modifying the coefficient of linear expansion which is formed of a metal oxide other than aluminum oxide and silicon dioxide, and a metal component with a smaller coefficient of linear expansion than aluminum oxide, where the content of the silicon dioxide component is a percentage by volume of from 5to 30% of the total volume.

3. Cermet as claimed in claim 2, wherein the cermet has an average coefficient of linear expansion in a temperature range of from 25° C. to 350° C. of $5.6\times10^{-6}$ to $7.6\times10^{-6}$ (1/K).

4. Discharge lamp of translucent ceramic comprising a discharge vessel with an arc tube part and tube parts which are joined to opposite ends of the arc tube part, a pair of opposed discharge electrodes in the arc tube, and a hermetically sealing arrangement formed of hermetically sealing components which have been frit-welded onto the tube parts so as to hermetically seal the tube parts; wherein upholding parts, on tips of which the discharge electrodes are located, have base parts that are located within the hermetically sealed components; wherein the hermetically sealing components are formed of a cermet comprising an aluminum oxide component, a silicon dioxide component, a component for modifying the coefficient of linear expansion which is formed of a metal oxide other than aluminum oxide and silicon dioxide, and a metal component with a smaller coefficient of linear expansion than aluminum oxide, wherein the discharge lamp has an average coefficient of linear expansion in a temperature range of from 25° C. to 350° C. of $5.6\times10^{-6}$ to $7.6\times10^{-6}$ (1/K).

5. Discharge lamp of translucent ceramic as claimed in claim 4, wherein the hermetically sealed components are cylindrical and form a hermetically sealed arrangement with outside faces of the hermetically sealed tube parts.

6. Discharge lamp of translucent ceramic as claimed in claim 4, wherein the hermetically sealed components are disk-shaped and form a hermetically sealed arrangement with outside faces of the hermetically sealed tube parts.

7. Discharge lamp of translucent ceramic comprising a discharge vessel with an arc tube part and tube parts which are joined to opposite ends of the arc tube part, a pair of opposed discharge electrodes in the arc tube, and a hermetically sealing arrangement formed of hermetically sealing components which have been frit-welded onto the tube parts so as to hermetically seal the tube parts; wherein upholding parts, on tips of which the discharge electrodes are located, have base parts that are located within the hermetically sealed components; wherein the hermetically sealing components are formed of a cermet comprising an aluminum oxide component, a silicon dioxide component, a component for modifying the coefficient of linear expansion which is formed of a metal oxide other than aluminum oxide and silicon dioxide, and a metal component with a smaller coefficient of linear expansion than aluminum oxide, where the content of the silicon dioxide component of the cermet is a percentage by volume of from 5 to 30% of the total volume.

8. Discharge lamp of translucent ceramic as claimed in claim 7, wherein the discharge lamp has an average coefficient of linear expansion in a temperature range of from 25° C. to 350° C. of $5.6\times10^{-6}$ to $7.6\times10^{-6}$ (1/K).

* * * * *